US007543413B2

(12) United States Patent
Sourlis

(10) Patent No.: US 7,543,413 B2
(45) **Date of Patent: *Jun. 9, 2009**

(54) DRAINAGE SYSTEM FOR USE IN BUILDING CONSTRUCTION

(76) Inventor: Tom Sourlis, 3646 Ridge Rd., Highland, IN (US) 46322

( * ) Notice: Subject to any disclaimer, the term of this patent is extended or adjusted under 35 U.S.C. 154(b) by 226 days.

This patent is subject to a terminal disclaimer.

(21) Appl. No.: 11/145,799

(22) Filed: Jun. 6, 2005

(65) Prior Publication Data

US 2006/0283102 A1 Dec. 21, 2006

(51) Int. Cl.
*E04B 2/00* (2006.01)
*E04B 1/70* (2006.01)

(52) U.S. Cl. ..... 52/169.5; 52/302.3; 52/606

(58) Field of Classification Search ..... 52/169.5, 52/169.14, 379, 58, 61–62, 302.1, 302.3, 52/302.4, 302.6, 302.7

See application file for complete search history.

(56) References Cited

U.S. PATENT DOCUMENTS 3,293,810 A * 12/1966 Cox et al. ..... 52/302.6
3,654,765 A * 4/1972 Healy et al. ..... 405/45
4,910,931 A * 3/1990 Pardue, Jr. ..... 52/169.5
6,023,892 A * 2/2000 Sourlis ..... 52/169.5
6,131,353 A * 10/2000 Egan ..... 52/408
6,202,366 B1 * 3/2001 Snyder et al. ..... 52/97
6,591,559 B2 * 7/2003 Contreras et al. ..... 52/101
6,672,016 B2 * 1/2004 Janesky ..... 52/169.5
7,216,460 B2 * 5/2007 Sourlis ..... 52/169.5

* cited by examiner

*Primary Examiner*—Richard E Chilcot, Jr.
*Assistant Examiner*—Chi Q Nguyen
(74) *Attorney, Agent, or Firm*—McDonnell Boehnen Hulbert & Berghoff LLP

(57) ABSTRACT

A flashing and drainage system for use in cavity wall construction, including a flashing member is sized and shaped to be received within a cavity of the wall and over a base member. The flashing member includes a lower flashing portion, which is oriented generally horizontally when atop a foundation portion of the wall, and an upper flashing portion, which is oriented generally vertically within the cavity of the wall. A plurality of weep tabs are positioned on the lower flashing portion and spaced apart to correspond to weep holes formed through the wall and a plurality of porous bodies are positioned on the upper flashing portion. Each of the plurality of porous bodies have a porosity sufficient to permit water to pass therethrough but substantially insufficient to permit mortar and debris to pass therethrough, each of the plurality of porous bodies being positioned to protect a corresponding one of the plurality of weep tabs.

24 Claims, 5 Drawing Sheets

DRAINAGE SYSTEM FOR USE IN BUILDING CONSTRUCTION

FIELD OF THE INVENTION

This invention generally relates to systems, such as are used in association with cavity wall construction, which function to reduce or prevent water damage entering or trapped in the wall. More particularly, the invention is directed to a system which includes flashing elements which function to direct water from a wall in which it is installed, drainage elements associated with the flashing elements to direct water from the flashing and additional elements to prevent mortar and debris from interfering with drainage.

BACKGROUND OF THE INVENTION

The present invention is at least applicable to so-called cavity wall construction. Cavity walls may be composed of two wythes of masonry, usually brick and concrete block, which may be secured together by, for example, metal ties and spaced apart by a cavity between the wythes. The inner wall may be constructed from wood with an inner surface of drywall, structural clay tile, vertical stacks of mortared bricks or blocks, or a shear concrete surface, for example. The outer wall is typically formed of bricks and held together by mortar. A space, or cavity, exists between the two walls, in part for drainage purposes and which may also be partially filled with insulation. It is applicant's understanding that the Brick Institute defines a "cavity wall" as having a space greater than about 2 inches but not more than 4 inches between the wythes. However, the present invention is useful in spaces between inner and outer walls spaced apart less than 2 inches, and more than 4 inches.

In conventional cavity wall construction, flashing is typically installed atop the foundation and weep holes are formed to collect moisture and drain the cavity. Moisture may penetrate the exterior wythe of the wall through a number of places, including top caps, copings, sills, windows, and may penetrate the wall itself through cracks or weaknesses, for example. It is well established that moisture is undesirable in brick or similar wall construction. The presence of water in freezing temperatures may cause cracks in the wall when water expands as it freezes. Trapped water may cause discolorations and other problems, and may even migrate into the dwelling. Another hazard of failing to deal with water is the formation of mold. It is widely accepted that mold growth can damage a building or render the building uninhabitable for various reasons. These reasons include a dangerous situation where the mold growth produces toxins and/or allergens sufficient to sicken inhabitants.

To overcome the problems associated with trapped water, weep holes are commonly included along the base of the outer side of and in the lowermost course of bricks or other masonry units. The weep holes allow water to pass from inside the wall. Also, the weep holes permit water to drain outside the wall structure. A flashing disposed in the wall cavity directs the collected water toward the weep holes.

A problem of cavity wall construction occurs during construction of a cavity wall, when excess mortar and other debris falls into the cavity. When the bricks or blocks are stacked during the erection of the wall, for example, mortar droppings are squeezed into the cavity. The excess mortar materials, as well as other debris, such as insulation, drops to the base of the cavity, and can block weep holes. The same problem can reduce the effectiveness of flashing. To address this problem, inserts, generically be referred to as a cavity mortar collection device, may be used in the cavity. Successful devices designed to address the problem of moisture and debris in cavity wall construction are shown, for example, in U.S. Pat. Re. 36,676, incorporated herein by reference.

A major consideration of construction is, of course, cost. A substantial cost may be associated with the time it takes for installation of some flashing devices and cavity inserts. The complexity of some of these moisture and debris control solutions can be a substantial factor adding cost to the construction of cavity walls. The present invention is directed to solving one or more of the problems discussed above, in a novel and simple manner.

SUMMARY OF THE INVENTION

In accordance with the invention, there is provided a flashing and drainage system for use in cavity wall construction, including a flashing member, which is sized and shaped to be received within a cavity of the wall and over the base member. The flashing member includes a lower flashing portion which is oriented generally horizontally when atop a foundation portion of the wall and an upper flashing portion which is oriented generally vertically, and preferably snugly, within the cavity of the wall. A plurality of weep tabs are positioned on the lower flashing portion and spaced apart to correspond to weep holes formed through the wall and a plurality of porous bodies are positioned on the upper flashing portion. Each of the plurality of porous bodies have a porosity sufficient to permit water to pass therethrough but substantially insufficient to permit mortar and debris to pass therethrough, each of the plurality of porous bodies being positioned to protect a corresponding one of the plurality of weep tabs.

Other aspects of the flashing and drainage system provide a drip edge formed at a distal end of the lower flashing portion. The system may further include a base portion, which is sized and shaped to fit underneath the flashing member. A pair of end dams may be formed at opposite ends of the flashing member. One or more reinforcing member may be attached adjacent an upper edge of the upper flashing portion to reinforce the upper flashing portion. Each of the plurality of weep tabs may be provided as individual strips of material. The plurality of weep tabs may also be attached at a proximal end to a common body portion of material. The system may also include further a plurality of corner pieces sized and shaped to cover a corner of a foundation underneath a cavity wall construct and adapted to abut the base portion to form a base for a plurality of the flashing members when the flashing members are placed end to end over the base portions and the corner pieces. The corner pieces may be both outer corner pieces and outer corner pieces.

Further features and advantages of the invention will be readily apparent from the specification and from the drawings.

DETAILED DESCRIPTION OF THE INVENTION

Figure 1:
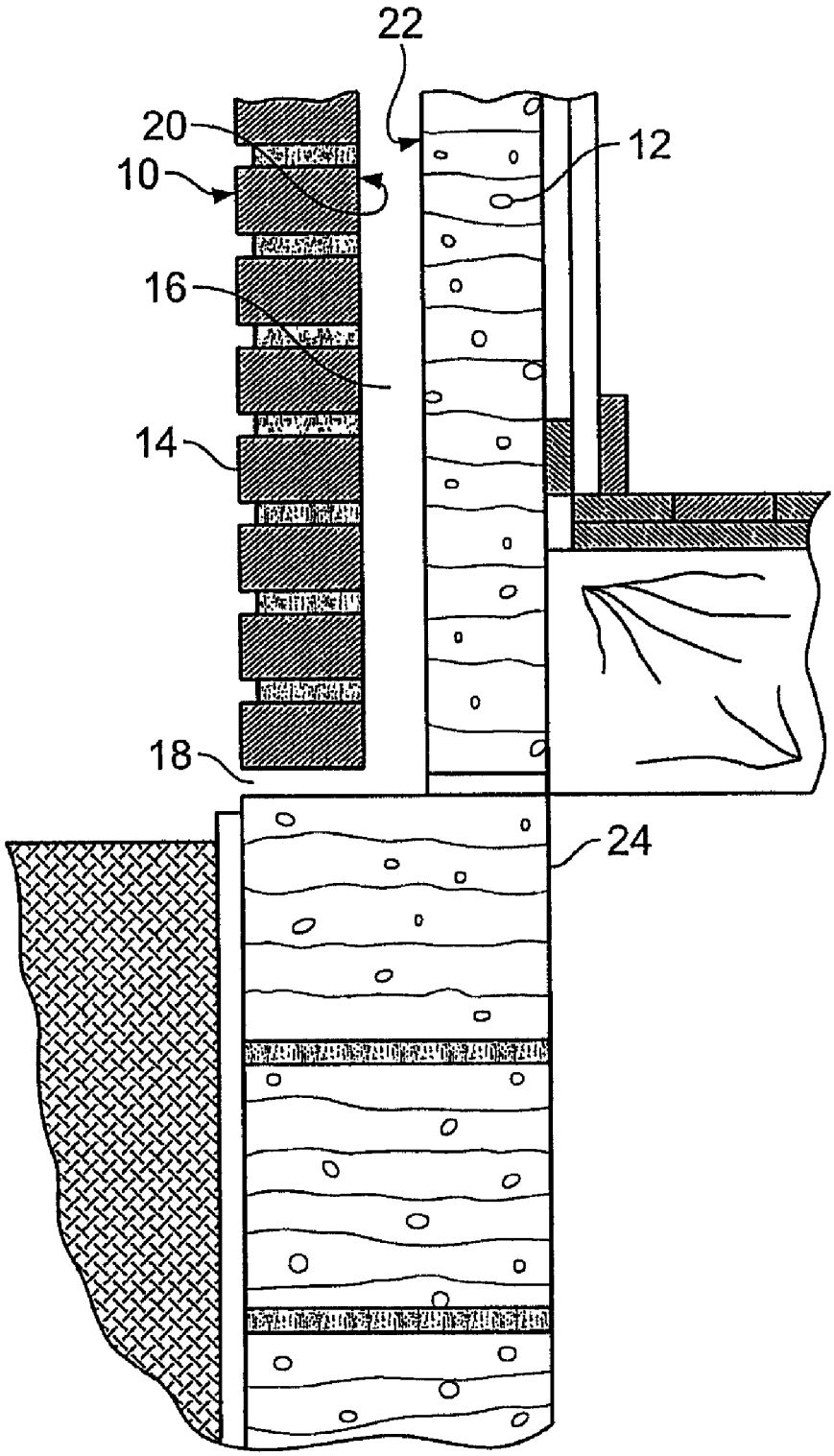
FIG. 1 shows a conventional cavity wall construction in cross section.

A cavity wall 10, as shown in FIG. 1 may consist of two wythes 12, 14 of masonry built upon a foundation 24. The two wythes are separated by an air space 16. The interior wythe (the inner wall) 12 may be brick, hollow brick, structural clay tile, wood or hollow or solid concrete masonry units, for example. The exterior wythe 14 (the outer wall) may be brick. A cavity 16 is defined between the two wythes, i.e., between inner or interior faces 20, 22 of outer and inner walls 14, 12 respectively. The cavity 16 may be either provided with insulation or left open as air space. The cavity 16 has a typical width of about 2 to about 4½ inches, but could be smaller, although non-standard. Of course, the wall 10 may be brick or block construction and may have components formed from wood, stud, steel stud and other construction techniques, materials and methods, which include a cavity 16 or the equivalent.

As mentioned above, a common problem associated with a cavity wall construction is how to allow moisture, as from seepage or condensation, for example, to pass from the cavity 16 to outside the wall 10. Weep holes 18 are formed to provide an unobstructed opening passing from the cavity to the outside of the wall. Generally, the weep holes 18 will be placed approximately one to two feet apart at the base of the outer wall 14. It has been found that moisture collecting in the cavity tends to run down the inside face 20 of the outer wall 14.

In the course of construction of a cavity wall 10, mortar and other debris (not shown will commonly fall into the cavity 16 between the inner wall 12 and outer wall 14. If enough mortar builds up around the weep holes 18, or if it simply lodges in the weep holes, the weep holes will become plugged, causing water to pond between the walls 12, 14. The water can then leak into the foundation 24, building structure, or cause cracking, deterioration and/or discoloration of the walls.

Figure 2:
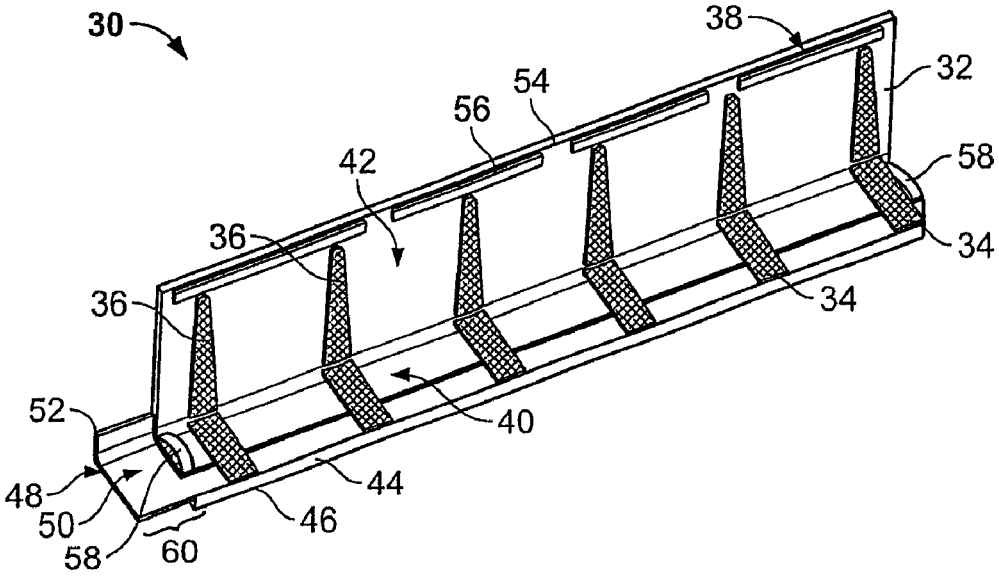
FIG. 2 shows a perspective view of a flashing and drainage assembly according to one embodiment of the invention.
Figure 3:
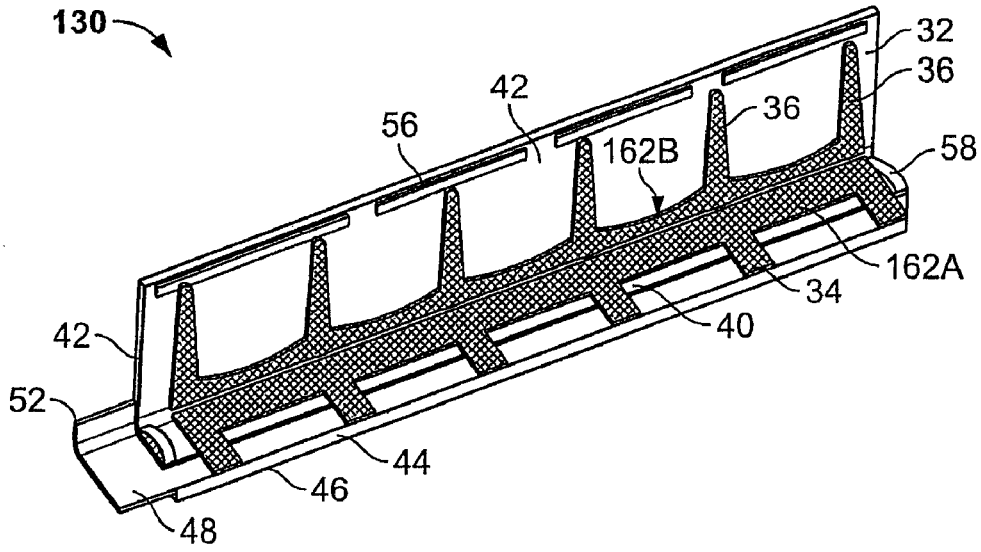
FIG. 3 shows a perspective view of a flashing and drainage assembly according to another embodiment of the invention.

Referring to FIGS. 2 and 3, a drainage system 30 is illustrated for use in connection with cavity wall construction. The drainage system 30 includes three main parts, which will be described in detail below, with a number of additional elements optionally associated therewith and forming various embodiments of the invention. The system 30 includes flashing member 32. The flashing member 32 is provided with one or more weep tabs 34. The flashing member 32 also includes one or more vertical mesh members 36.

The flashing member 32 may be any conventional flashing material, for example stainless steel, cold-rolled copper, lead coated copper, galvanized steel, copper laminates and other metals, for example, aluminum, EPDM (man-made rubber), rubberized asphalt, polyvinyl chloride (PVC) and other plastics and composite materials. Preferably, the flashing member 32 is formed of modified bitumen and more preferably, includes a "peel-and-stick" type adhesive and protective backing sheet (not shown) on a backside 38 thereof.

The flashing member 32 shown is rectangular and may advantageously be about 5-7 feet in length and includes a lower flashing portion 40 and a more upright upper flashing portion 42. The flashing member 32 may be other lengths as needed or desired. The lower flashing portion 40 is positioned over the top of a foundation of a building or the like, or a lower course of bricks, or blocks and so on. The upper flashing portion 42 is positioned generally vertically in a wall cavity 16 and spaced from an inside face 20 of the outer wythe 14 and in contact with an inner face 22 of the inner wythe 12 and keep spaced from the inside face 20 of the outer wythe 14 by pressure between the brick of the outer wythe and the mesh material 36.

The weep tabs 34 are positioned atop the lower flashing portion and are sized, shaped and spaced to extend through the weep holes 18 (FIG. 1) of wall 10. The tabs 34 are formed of a porous and/or wicking material, like an open mesh plastic, cotton, wool or hemp material capable of functioning to transmit water from atop the flashing 32 and out the weep holes 18 (FIG. 1). In the illustrated embodiment, the weep tabs 34 are separate strips of material.

The vertical mesh bodies 36 are positioned on the upper flashing portions 42 and spaced in a manner to deflect and/or prevent debris and mortar from occluding the tabs 34. Furthermore, the depth of the vertical bodies 36 are provided so as to space the vertical flashing portion 42 from the inner face 20 of the outer wall 14 and generally adjacent the inner face 22 of the inner wall 12. In one example, the vertical bodies 36 are about 1 inch thick.

The vertical bodies 36 may be formed of any suitable fibroid water permeable material 28. The material of the vertical bodies 36 should resist compression when under the weight of debris and mortar and continue to permit water to pass through. In this embodiment, each body 36 has a generally rectangular shape that will rest flush against the wall 14. The width of the body 36 may roughly determined by or correspond to the width of the cavity 16. Other shapes, which will be shown in more detail below include square, trapezoid, triangular, inverted trapezoid and triangular, hourglass and wineglass shaped as well as other shapes, for example, smooth or curved shapes.

The body 36 is preferably composed of non-absorbent plastic, such as, for example, the filament-type plastic used to surface walk-off mats. These materials are preferred because they are water-impervious, relatively inexpensive and can be formed into dividable blocks or sheets. A quantity of one or more of these materials can be formed into a mass of random fibers with a density which is sufficient to catch and support mortar and other debris thereon without significant collapse, but allow water to pass freely therethrough. An objective of the vertical mesh bodies 36 is to separate clumps of mortar and debris and direct the mortar and debris away from the weep tabs 34 and ultimately prevent mortar and debris from preventing the egress of water from within the cavity 16.

The porosity of the body 36 made from the fibrous material can be quite varied, so long as it effectively serves to strain out the mortar and debris before it reaches the weep holes 16. Most mortar and debris will be quite large, i.e., greater than ⅛ or 1/16 of an inch or clearly visible to the naked eye, so an amount of porosity sufficient to catch such relatively large particulate matter will suffice to prevent plugging of the weep holes 16.

The drainage system 30 of this invention may simply be positioned on the wall foundation in cavity 16 without the need of any fixation device. In the alternate, the device 30 may be caulked in place. In yet another embodiment, the flashing backside 38 may be supplied with a pressure sensitive adhesive, which is protected by a backing sheet (not shown). Pressure sensitive adhesives are well known.

The drainage system 30 illustrated includes other features. The lower flashing portion 40 may include a drip edge 44 at a leading edge thereof. The drip edge 44 is preferably stainless steel, although other suitable materials are contemplated by the invention, such as copper, aluminum, plastic, elastomeric materials, and so on. The drip edge 44 may be a strip of material, such as stainless steel bonded or otherwise connected to the bottom of the lower flashing portion 40 or may be an extended lip formed from the flashing portion itself. The lower edge 46 of the drip edge 44 is turned down vertically, preferably about 75 degrees, and may be plain or rolled back to provide a finished edge.

The drainage system 30 may include a base 48, which may function as a pan or the like, underneath the flashing 32, which includes a horizontal base portion 50 and a back leg portion 52. The horizontal base portion 52 is rectangular and is positioned underneath the lower flashing portion 40 and may extend to a position adjacent the drip edge 44. The back leg 52, which preferably is inclined about 30 degrees, forms a dam at the back edge thereof and also causes the flashing member 32 to be inclined at the juncture of the lower and upper portions 40, 42, so as to encourage the egress of water from the flashing and out weep holes 16. The back leg 52 prevents water that infiltrates past the flashing 32 to enter the foundation. As will be shown in more detail below, the back leg 52 may be an angled piece, a separate piece or a triangular piece to produce a dam effect in the base 48 and alternately in the base and flashing 32. In a preferred embodiment, the base 46 and drip edge 44 are formed from a single sheet of material (see FIG. 6B), but also may be separate (see FIG. 6A).

At a top edge 54 of the upper portion 42 of flashing 32 one or more rigid horizontal bars 56 may be optionally provided to enhance the rigidity of the flashing upper portion. The horizontal bars 56 function to prevent the upper portion 42 of the flashing 32 from drooping or being dislodged from against the inner surface 22 of inner wall 12. The bar 56 may be cylindrical or rectangular, for example, and affixed to the upper portion 42 by adhesives or fasteners, like screws. The bar 56 may be provided in a pocket or hem of the flashing material and also may be affixed to the inside surface 22 of the inner wall 12 by screws, anchors, or other fasteners, for example.

A pair of end dams 58 is formed at opposite ends of the lower portion 40 of the flashing 32 to raise the end sections of the flashing. Like the back leg 52, the end dams 58 function to direct water off the flashing and away from the foundation. The end dams 58 may be formed by turning edges of the flashing material 40 upwardly or inserting some thickness of material underneath the flashing.

An extension 60 of the base 48 is provided for joining together in an end-to-end fashion multiple units 30. The extension 60 is preferably about 4 inches long, but may be anywhere from about 1 inch to 6 inches or more. When adjacent units 30 are joined, the ends of the flashing 32 are covered with a waterproof tape-like material, like a 4-inch strip of modified bitumen to provide a seal over the joint. The base extension 60 ensures that any water coming through the joint will be directed away from the wall.

The device 130 shown in FIG. 3 is similar to that shown in FIG. 2 except that the weep tabs 34 are all formed and extend from a common body portion 162A formed of the same material as the weep tabs. The common body portion 162A is positioned on the flashing 32 on the lower panel 40 thereof so as to align the tabs 34 with vertical mesh towers 36, which themselves are positioned in a spaced configuration on the vertical or upper panel of the flashing. Similarly, the vertical mesh bodies 36 may be joined at lower edges thereof from a common body portion 162B.

Figure 4:
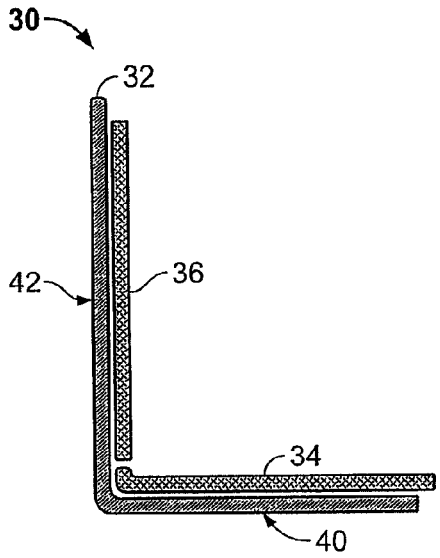
FIG. 4 shows a cross sectional view of an embodiment of the invention.

FIG. 4 shows one embodiment of the invention in a more basic form. The device 30 includes an L-shaped flashing member 32. The flashing member 32 includes a lower flashing portion 40 which is generally horizontal and is sized and shaped to fit over the top of a foundation or the like. An upper flashing portion 42 extends upwardly from a back edge of the lower flashing portion 40 and is adapted, sized and shaped to fit within a wall cavity and lean against, be adhered to or fastened to the face of an interior wall 22 facing the cavity 16.

One or more weep tabs 34 are positioned on the lower flashing portion 40 and spaced and/or positioned to cooperate with weep holes 18 in an outer wythe 14 of wall 10 (FIG. 1). A vertical mesh body 36 is positioned on the upper flashing portion 42 to cooperate with each of the weep tabs 34 and prevent debris and mortar from occluding the effectiveness of the weep tabs from removing water from atop the flashing 32. The vertical mesh body 36 also functions to space the upper flashing portion 42 from an inner face 20 of outer wall 14 and against the wall face 22 (FIG. 1).

Figure 5:
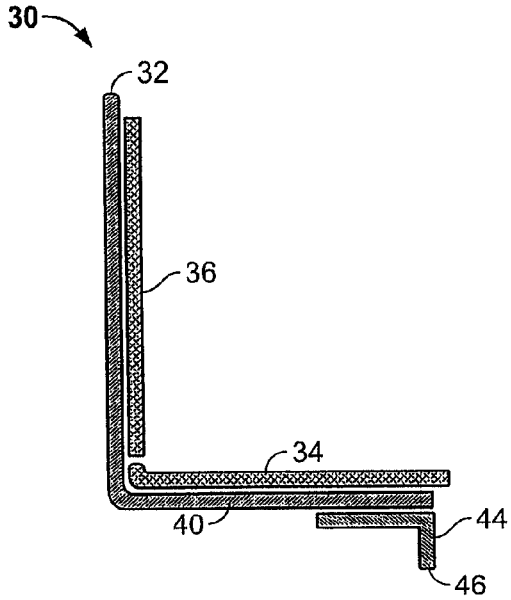
FIG. 5 shows a cross sectional view of another embodiment of the invention.

FIG. 5 shows the device 30 of FIG. 4 with the addition of a drip edge 44. As above, the drip edge 44 may be a separate piece formed of a material like stainless steel, modified bitumen or the equivalent, or may be a turned down lip of the lower flashing portion 40 of the flashing member 32.

Figure 6A:
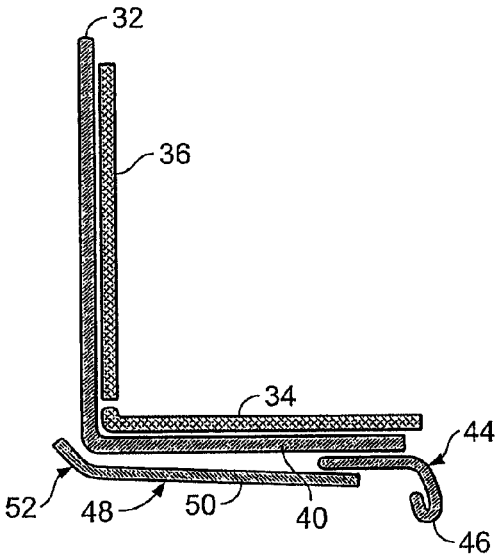
FIG. 6A shows a cross sectional view of yet another embodiment of the invention.

FIG. 6A shows the device 30 of FIG. 4 with the addition of base 48. Like the drip edge 44 the base 48 is preferably made of a water impervious material, like stainless steel or an equivalent thereof. The base 48 is positioned underneath the lower flashing portion 40 and drip edge 46. The base 48 includes a flat horizontal portion 50 and a rear leg 52 which functions to elevate the rear section of the lower flashing portion 40 and direct water thereon towards and out through weep holes 18 in the outer wall 14 (FIG. 1). In this embodiment, the distal end 46 of the drip edge 44 is curved back to provide a smooth edge and resist the tendency for water to reenter the foundation 24 (FIG. 1) once arriving at the drip edge.

Figure 6B:
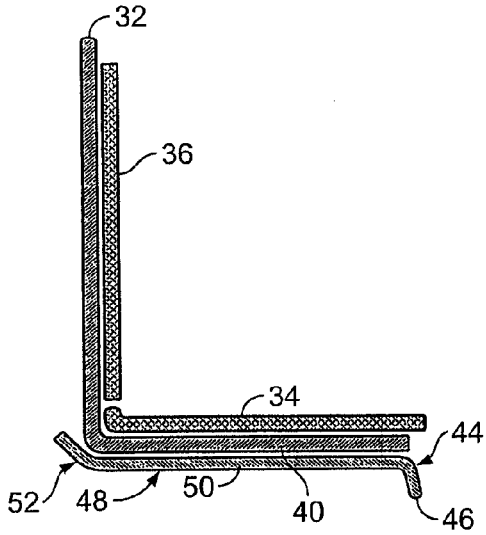
FIG. 6B shows a cross sectional view of yet another embodiment of the invention.

FIG. 6B shows the device 30 of FIG. 6A with the addition of a combined base 48 and drip edge 44 forming a tray (combined pan or base 48 and drip edge 44). As above, the base 48 and drip edge 44 are preferably made of a water impervious material, like stainless steel or an equivalent thereof. The unitary or combined base 48 and drip edge 44 is positioned underneath the lower flashing portion 40. The base 48 includes a flat horizontal portion 50 and a rear leg 52 which functions to elevate the rear section of the lower flashing portion 40 and direct water thereon towards and out through weep holes 18 in the outer wall 14 (FIG. 1). The leg 52 may be angled at about 30 degrees. The distal end 46 of the drip edge 44 is angled almost vertically to provide a compact profile against the outer wall and urge water off of the base 48.

Figure 7:
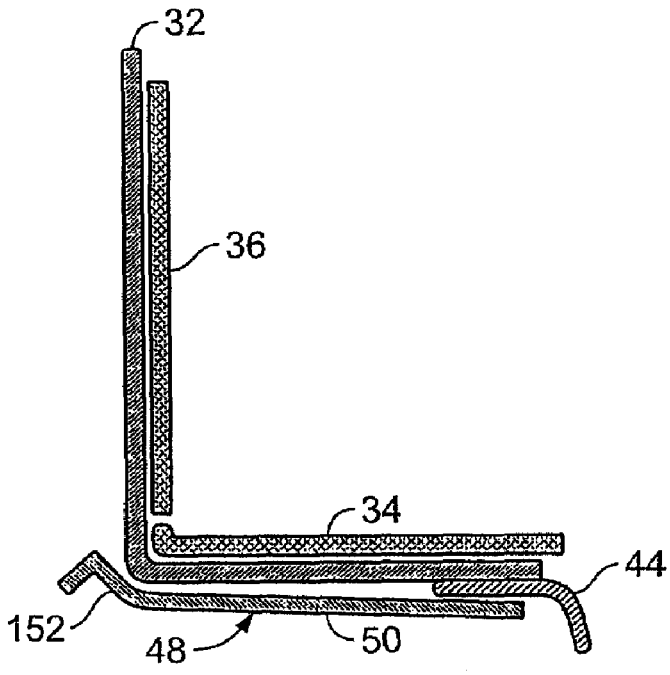
FIG. 7 shows a cross sectional view of yet another embodiment of the invention.

FIG. 7 shows the device 30 of FIG. 4 with the addition of base 48 and drip edge 44 underneath flashing 32. The base 48 includes a flat horizontal portion 50 and a rear leg 152, which is different from the leg 52 of FIG. 6 in that the leg has a triangular shape instead of being an upturned edge. It functions similarly to that shown in FIG. 6 to elevate the rear section of the lower flashing portion 40 and direct water thereon towards and out through weep holes 18 in the outer wall 14 (FIG. 1).

Figure 8:
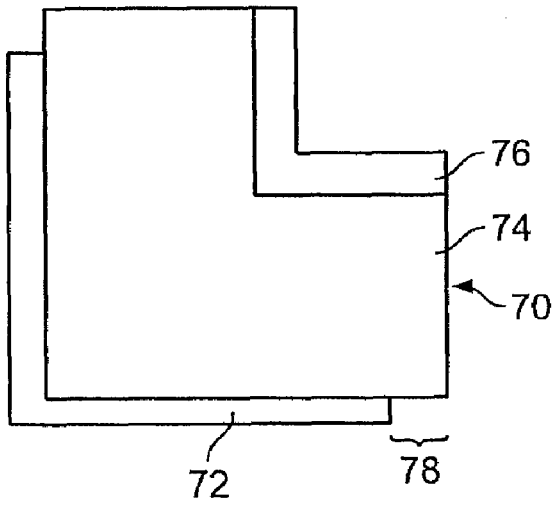
FIG. 8 shows a corner assembly usable with any of the embodiments shown in FIGS. 2-7.

FIG. 8 shows a corner piece 70 for use with device 30 (FIG. 2) of the present invention. The corner piece 70 may be made of any suitable material, for example, stainless steel, copper, aluminum, plastic, modified bitumen, and so on. The corner piece has three main sections, namely a corner drip edge 72, which is turned down, a horizontal main corner portion 74 and a back corner dam 76 which is raised up relative to the main portion. Extensions 78 of the main portion 74 extend under or overlap with section 60 (see FIGS. 2 and 3), base 40 or flashing 32 lower portion 40 when the flashing device 30 is laid over the corner piece 70. A corresponding inside corner piece (not shown) will also include similar features and will be used on inside corners of the cavity wall.

Figure 9:
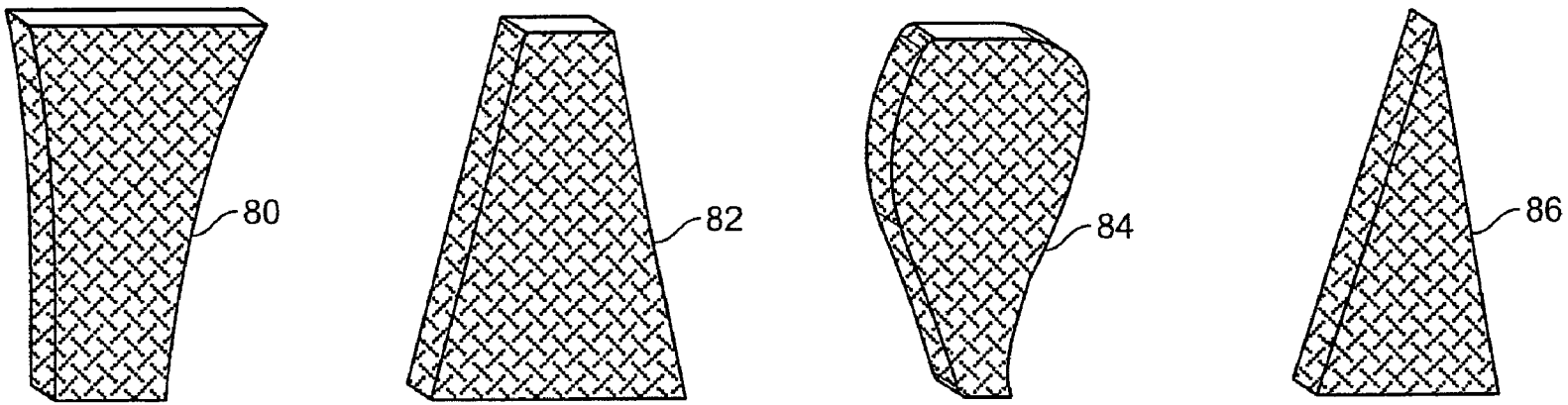
FIG. 9 shows alternate embodiments of a mesh body.

FIG. 9 illustrates several embodiments of the mesh bodies 36. In particular, the mesh bodies may be an inverted wedge shape (inverted trapezoidal) 80, a wedge shape (trapezoidal) 82, wine glass shape 84 and triangular 86, for example.

In use and referring to at least FIGS. 1, 2 and 8, the back corner dam 76 portion of the corner piece 70 is positioned against the inner wall 12 and atop the foundation 24 (FIG. 1) or the like at a corner thereof with the drip edge 72 extending outwardly over the outermost edge of the corner of the foundation 24. The corner piece 70 may be fixed in position with caulk or the like or any other suitable method. The base 48 is positioned in an overlapping relationship with the corner piece 70 atop the foundation 24 and similarly sealed and/or fixed into position with caulk or the like.

The flashing member 32, which may be in an initial folded condition, i.e., with tabs 34 and mesh 36 inside the folded upper and lower flashing portions 42, 40, is positioned longitudinally along the foundation 24 over the base 48. It will be understood that the base 48 may be provided pre-attached to the underside of the lower flashing portion 40 or separately. Initially, the lower flashing portion 40 is placed on the foundation and then the upper flashing portion 42 is raised against wall 12. If a backing material (not shown) is used to protect a pressure sensitive adhesive on the flashing device 30, it is removed just prior to positioning the flashing 32. Furthermore, the flashing member 32 may be secured in place with adhesive, fasteners, caulk and so on or held in place by the weight of the device until bricks of the wall 10 are put into place.

The weep tabs 324 are aligned with the position of the weep holes 18 of the outer wall 14. Adjacent flashing units 30 or flashing device 32 are sealed at abutting portions, i.e., at the end dams 58 to prevent or reduce leakage at the joints between units.

I claim:

1. A flashing and drainage system for use in cavity wall construction, comprising: a flashing member sized and shaped to be received within a cavity of the wall, said flashing member including a lower flashing portion which is oriented generally horizontally atop a foundation portion of the wall and a upper flashing portion which is oriented generally vertically within the cavity of the wall; a plurality of weep tabs positioned on said lower flashing portion and spaced apart to correspond to weep holes formed through the wall; and a plurality of porous bodies positioned on said upper flashing portion, each of said plurality of porous bodies having a porosity sufficient to permit water to pass therethrough but substantially insufficient to permit mortar and debris to pass therethrough, each of said plurality of porous bodies being positioned to protect a corresponding one of said plurality of weep tabs.

2. The system of claim 1, wherein said flashing member is formed of one or more of stainless steel, cold-rolled copper, lead-coated copper, galvanized steel, copper laminates, aluminum, EPDM, rubberized asphalt, polyvinyl chloride (PVC) plastic, composite materials and modified bitumen.

3. The system of claim 1, wherein said flashing member includes backside including a pressure-sensitive adhesive material and a backing material covering said adhesive.

4. The system of claim 1, wherein said flashing member is rectangular and about 5 feet in length.

5. The system of claim 1, wherein said weep tabs are formed of one or more of open mesh plastic, cotton, wool and hemp materials.

6. The system of claim 1, wherein each of said plurality of porous bodies are positioned to prevent occlusion of one or more of said plurality of weep tabs.

7. The system of claim 1, wherein each of said plurality of porous bodies are a thickness corresponding to distance between inner and outer wythes of the cavity wall.

8. The system of claim 1, wherein said plurality of porous bodies are formed of a material sufficient to resist compression when under the weight of debris and mortar.

9. The system of claim 1, wherein each of said plurality of porous bodies is one of square, trapezoid, triangular, inverted trapezoid, triangular, hourglass and wineglass shape.

10. The system of claim 1, further including a drip edge formed at a distal end of said lower flashing portion.

11. The system of claim 10, wherein said drip edge is a turned down portion of said lower flashing.

12. The system of claim 10, where said drip edge is a separate strip of material fixed to said distal end of said lower flashing portion.

13. The system of claim 1, further including a base portion, sized and shaped to fit underneath said flashing member.

14. The system of claim 13, wherein said base portion includes a rear dam.

15. The system of claim 14, wherein said base portion is formed of one or more of stainless steel, cold-rolled copper, lead-coated copper, galvanized steel, copper laminates, aluminum, EPDM, rubberized asphalt, polyvinyl chloride (PVC) plastic, composite materials and modified bitumen.

16. The system of claim 14, wherein said dam is a raised section of a rear portion of said base portion.

17. The system of claim 13, wherein said base member includes an extension, for overlapping with an adjacent flashing and drainage system.

18. The system of claim 13, further including a plurality of corner pieces sized and shaped to cover a corner of a foundation underneath a cavity wall construct and adapted to abut said base portion to form a base for a plurality of said flashing members when said flashing members are placed end to end over said base portions and said corner pieces.

19. The system of claim 18, wherein said plurality of corner pieces include both outer corner pieces and outer corner pieces.

20. The system of claim 1, wherein a pair of end dams is formed at opposite ends of said flashing member.

21. The system of claim 1, wherein a reinforcing member is attached adjacent an upper edge of said upper flashing portion to reinforce said upper flashing portion.

22. The system of claim 1, wherein each of said plurality of weep tabs is individual strips of material.

23. The system of claim 1, wherein said plurality of weep tabs are attached at a proximal end to a common body portion of material.

24. A flashing and drainage system for use in cavity wall construction, comprising: a longitudinal base member; a flashing member sized and shaped to be received within a cavity of the wall and over said base member, said flashing member including a lower flashing portion which is oriented generally horizontally atop a foundation portion of the wall and a upper flashing portion which is oriented generally vertically within the cavity of the wall; a plurality of weep tabs positioned on said lower flashing portion and spaced apart to correspond to weep holes formed through the wall; and a plurality of porous bodies positioned on said upper flashing portion, each of said plurality of porous bodies having a porosity sufficient to permit water to pass therethrough but substantially insufficient to permit mortar and debris to pass therethrough, each of said plurality of porous bodies being positioned to protect a corresponding one of said plurality of weep tabs.

* * * * *